US010932056B2

(12) United States Patent
Song et al.

(10) Patent No.: US 10,932,056 B2
(45) Date of Patent: Feb. 23, 2021

(54) SPEAKER

(71) Applicant: AAC Technologies Pte. Ltd., Singapore (SG)

(72) Inventors: Wei Song, Shenzhen (CN); Shuwen Wu, Shenzhen (CN); Zhiyuan Chen, Shenzhen (CN); Fan Zhang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/527,079

(22) Filed: Jul. 31, 2019

(65) Prior Publication Data

US 2020/0045468 A1 Feb. 6, 2020

(30) Foreign Application Priority Data

Aug. 4, 2018 (CN) ..... 2018 2 1255586 U

(51) Int. Cl.
*H04R 1/02* (2006.01)
*H04R 9/06* (2006.01)
*H04R 9/02* (2006.01)

(52) U.S. Cl.
CPC ..... *H04R 9/06* (2013.01); *H04R 9/027* (2013.01); *H04R 2400/11* (2013.01)

(58) Field of Classification Search
USPC ..... 381/386, 412, 420
See application file for complete search history.

(56) References Cited

U.S. PATENT DOCUMENTS 6,570,993 B1 * 5/2003 Fukuyama ..... G10K 9/22 381/396
6,795,563 B2 * 9/2004 Ohta ..... H04R 9/06 381/409
8,300,876 B2 * 10/2012 Xu ..... H04R 31/006 381/433
2009/0232345 A1 * 9/2009 Takase ..... H04R 31/006 381/412
2014/0153771 A1 * 6/2014 Ohashi ..... H04R 9/06 381/412
2016/0021460 A1 * 1/2016 Shi ..... H04R 9/025 381/398

* cited by examiner

*Primary Examiner* — Suhan Ni
(74) *Attorney, Agent, or Firm* — W&G Law Group LLP

(57) ABSTRACT

The present disclosure provides a speaker, including a housing and a vibration unit and a magnetic circuit unit that are received in the housing. The magnetic circuit unit includes a magnetic frame, the magnetic frame comprising a bottom wall and a sidewall extending from the bottom wall while being bent towards the housing. A positioning portion protruding outwardly is provided on the sidewall of the magnetic frame, and the positioning portion abuts against the housing. The speaker of the present disclosure can achieve the positioning of the magnetic frame using the positioning portion provided on the sidewall of the magnetic frame during the assembling, and it is unnecessary to sacrifice the flanging length of the magnetic frame, so that the flanging of the magnetic frame can be maximized, thereby improving the performance of the speaker.

11 Claims, 2 Drawing Sheets

SPEAKER

TECHNICAL FIELD

The present disclosure relates to the field of acoustic design technology, and in particular, to a speaker.

BACKGROUND

In the related art, a speaker includes a housing and a vibration unit and a magnetic circuit unit that are received in the housing. The magnetic circuit unit includes a magnetic frame, and a main magnet and a pole plate that are sequentially arranged in the magnetic frame. The magnetic frame includes a bottom wall and sidewalls extending from the bottom wall while being bent towards the housing. Moreover, in order to achieve that the magnetic frame has a Z-direction positioning, rounded corners are provided between two adjacent ones of the sidewalls.

However, as for the speaker in the above structure, the flanging feature of the magnetic frame and the Z-direction positioning feature (i.e., a rounded corner) do not overlap each other, such that a flanging length of the magnetic frame cannot be maximized, resulting in the poor speaker performance.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DESCRIPTION OF EMBODIMENTS

The present disclosure will be further illustrated with reference to the accompanying drawings and the present embodiments.

Figure 1:
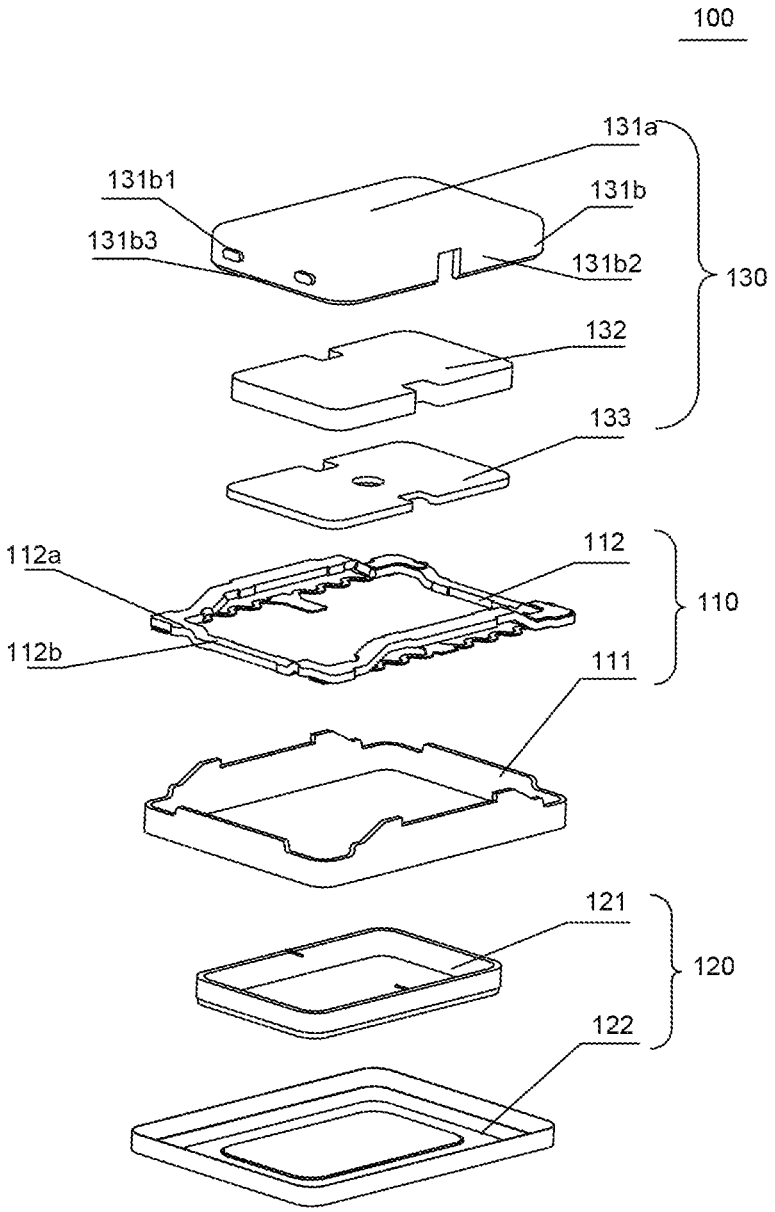
FIG. 1 is an exploded diagram of a speaker of the present disclosure.
Figure 2:
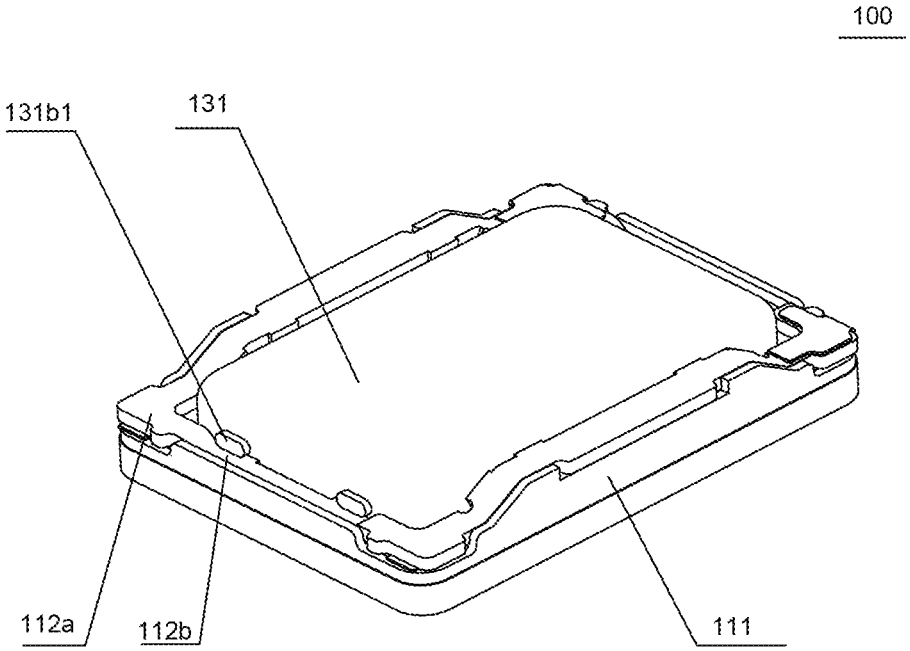
FIG. 2 is a perspective diagram of a speaker of the present disclosure.
Figure 3:
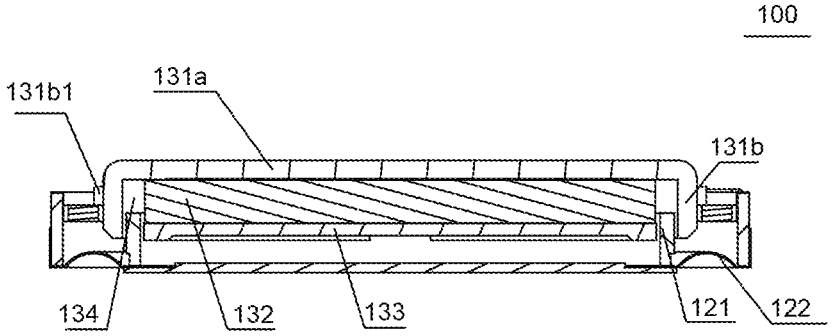
FIG. 3 is a cross-sectional diagram of a speaker of the present disclosure.

As shown in FIG. 1 to FIG. 3, the present disclosure relates to a speaker 100, and the speaker 100 includes a housing 110 and a vibration unit 120 and a magnetic circuit unit 130 that are received in the housing 110. The magnetic circuit unit 130 includes a magnetic frame 131. The magnetic frame 131 includes a bottom wall 131*a* and a sidewall 131*b* extending from the bottom wall 131*a* while being bent towards the housing 110. Further, a positioning portion 131*b*1 that protrudes outwardly is provided on the sidewall 131*b* of the magnetic frame 131, and the positioning portion 131*b*1 abuts against the housing 110.

Specifically, when the speaker 100 of the above structure is being assembled, the magnetic frame 131 is placed on the housing 110, and the Z-direction positioning of the magnetic frame 131 can be achieved by using the positioning portion 131*b*1 provided on the sidewall 131*b* of the magnetic frame 131, i.e., when the positioning portion 131*b*1 abuts against the housing 110, positioning of the magnetic frame 131 in the horizontal direction or the vertical direction can be achieved. In this way, when achieving the positioning of the magnetic frame 131, it is unnecessary to sacrifice the flanging length of the magnetic frame 131, so that the flanging of the magnetic frame 131 can be maximized, thereby improving the performance of the speaker 100.

It should be noted that the specific structure and the specific number of the positioning portions 131*b*1 provided on the sidewall 131*b* of the magnetic frame 131 are not limited. In practical applications, a person skilled in the art can determine the specific number and specific shape of the required positioning portions 131*b*1 according to actual needs.

As shown in FIG. 1, FIG. 2 and FIG. 3, the housing 110 includes a holder 111 and a bracket 112 connected to the holder 111. The bracket 112 is sandwiched between the sidewall 131*b* of the magnetic frame 131 and the holder 111, and the bracket 112 comprises an upper surface 1121 away from the vibration unit 120, a lower surface 1122 close to the vibration unit 120, and a side surface 1123 connecting the upper surface 1121 and the lower surface 1122; and the positioning portion 131*b*1 abuts against the upper surface 1121 of the bracket 112. The sidewall 131*b* has an orthographic projection on the bottom wall 131*a* along a vibration direction X of the vibration unit 120 not overlapping an orthographic projection of the bracket 112 on the bottom wall 131*a* along the vibration direction X of the vibration unit 120. The sidewall 131*b* comprises a top surface 1311 close to the vibration unit 120, a distance h1 from the top surface 1311 to the bottom wall 131*a* along the vibration direction X of the vibration unit 120 is greater than a distance h2 from the lower surface 1122 of the bracket 112 to the bottom wall 131*a*. In this way, the magnetic frame 131 abuts against the bracket 112 only through the positioning portion 131*b*1, when achieving the positioning of the magnetic frame 131, it is unnecessary to sacrifice the flanging length of the magnetic frame 131, so that the flanging of the magnetic frame 131 can be maximized, thereby improving the performance of the speaker 100.

Specifically, when the speaker 100 of such structure is being assembled, the bracket 112 and the holder 111 can be first assembled to form the structure of the housing 110. Thereafter, the magnetic frame 131 is assembled in the housing 110. During the assembly process, when the positioning portion 131*b*1 on the sidewall 131*b* of the magnetic frame 131 abuts against the upper surface of the bracket 112, it shows that the magnetic frame 131 has its horizontal or vertical position determined or has found its position in the horizontal or vertical direction. In this way, when achieving the positioning of the magnetic frame 131, it is unnecessary to sacrifice the flanging length of the magnetic frame 131, so that the flanging of the magnetic frame 131 can be maximized, thereby improving the performance of the speaker 100.

Specifically, as shown in FIGS. 1 and 2, the bracket 112 includes a first connecting portion 112*a* and a second connecting portion 112*b* recessed from the first connecting portion 112*a* in a direction facing away from the magnetic frame 131. The first connecting portion 112*a* is connected to the holder 111, and an upper surface of the second connecting portion 112*b* abuts against the positioning portion 131*b*1.

As shown in FIGS. 1 and 3, the magnetic frame 131 has a long axis direction and a short axis direction. The sidewall 131*b* includes two first sidewalls 131*b*2 that are arranged opposite to and spaced apart from each other along the long axis direction, and two second sidewalls 131*b*3 that are arranged opposite to and spaced apart from each other along the short axis direction and connecting the two first sidewalls 131b2. Further, as shown in FIGS. 1 and 3, the two second sidewalls 131b3 are respectively provided with a positioning portion 131b1. Further, the positioning portion 131b1 may be provided on the two first sidewalls 131b2. Of course, it is also possible to provide the positioning portion 131b1 on both the first sidewalls 131b2 and the second sidewalls 131b3, and the like.

By providing the positioning portion 131b1 on the two first sidewalls 131b2 and/or the two second sidewalls 131b3, the speaker 100 of the structure of the present embodiment can effectively achieve the positioning of the magnetic frame 131 in the horizontal direction or the vertical direction, and it is further unnecessary to sacrifice the flanging length of the magnetic frame 131, so that the flanging of the magnetic frame 131 can be maximized, thereby improving the performance of the speaker 100.

As shown in FIG. 1 and FIG. 3, each of the second sidewalls 131b3 is provided with two positioning portions 131b1 symmetrically arranged. Of course, it is possible that each of the first sidewalls 131b2 is provided with two positioning portions 131b1 symmetrically arranged. In addition, it is also possible that each of the first sidewall 131b2 and each of the second sidewalls 131b3 are respectively provided with two positioning portions 131b1 symmetrically arranged.

By providing two positioning portions 131b1, which are symmetrically arranged, on the two first sidewalls 131b2 and/or the two second sidewalls 131b3, the speaker 100 of the structure of the present embodiment can effectively achieve the positioning of the magnetic frame 131, and it may be further unnecessary to sacrifice the flanging length of the magnetic frame 131, so that the flanging of the magnetic frame 131 can be maximized, thereby improving the performance of the speaker 100.

As shown in FIG. 1 and FIG. 3, the magnetic circuit unit 130 further includes a main magnet 132 and a pole plate 133 that are sequentially provided in the magnetic frame 131. There is a magnetic gap 134 provided between the magnetic frame 131 and each of the main magnet 132 and the pole plate 133.

As shown in FIGS. 1 and 3, the vibration unit 120 includes a voice coil 121 and a voice diaphragm 122. The voice coil 121 is inserted in the magnetic gap 134, and the voice diaphragm 122 is connected to an end of the voice coil 121 facing away from the pole plate 133.

What has been described above is only an embodiment of the present disclosure, and it should be noted herein that one ordinary person skilled in the art can make improvements without departing from the inventive concept of the present disclosure, but these are all within the scope of the present disclosure.

What is claimed is:

1. A speaker, comprising:

a housing; and a vibration unit received in the housing; and a magnetic circuit unit received in the housing, wherein the magnetic circuit unit comprises a magnetic frame, the magnetic frame comprising a bottom wall and a sidewall extending from the bottom wall while being bent towards the housing, and at least one positioning portion protruding outwardly is provided on the sidewall of the magnetic frame, the positioning portion abutting against the housing; the housing comprises a holder and a bracket connected to the holder, the bracket being sandwiched between the sidewall of the magnetic frame and the holder, the bracket comprises an upper surface away from the vibration unit, a lower surface close to the vibration unit, and a side surface connecting the upper surface and the lower surface; and the at least one positioning portion abutting against the upper surface of the bracket the sidewall has an orthographic projection on the bottom wall along a vibration direction of the vibration unit not overlapping an orthographic projection of the bracket on the bottom wall along the vibration direction of the vibration unit.

2. The speaker as described in claim 1, wherein the bracket includes a first connecting portion and a second connecting portion recessed from the first connecting portion in a direction away from the magnetic frame, the first connecting portion being connected to the holder, and an upper surface of the second connecting portion abutting against the at least one positioning portion.

3. The speaker as described in claim 2, wherein the magnetic circuit unit further includes a main magnet and a pole plate that are sequentially arranged in the magnetic frame, and a magnetic gap is provided between the magnetic frame and each of the main magnet and the pole plate.

4. The speaker as described in claim 1, wherein the magnetic frame has a long axis direction and a short axis direction, the sidewall comprising two first sidewalls that are arranged opposite to and spaced apart from each other along the long axis direction, and two second sidewalls that are arranged opposite to and spaced apart from each other along the short axis direction and connecting the two first sidewalls, each of the first sidewalls being provided with one or more of the at least one positioning portion and/or each of the second sidewalls being provided with one or more of the at least one positioning portion.

5. The speaker as described in claim 4, wherein each of the first sidewalls is provided two positioning portions symmetrically arranged and/or each of the second sidewalls is provided with two positioning portions symmetrically arranged.

6. The speaker as described in claim 5, wherein the magnetic circuit unit further includes a main magnet and a pole plate that are sequentially arranged in the magnetic frame, and a magnetic gap is provided between the magnetic frame and each of the main magnet and the pole plate.

7. The speaker as described in claim 4, wherein the magnetic circuit unit further includes a main magnet and a pole plate that are sequentially arranged in the magnetic frame, and a magnetic gap is provided between the magnetic frame and each of the main magnet and the pole plate.

8. The speaker as described in claim 1, wherein the magnetic circuit unit further includes a main magnet and a pole plate that are sequentially arranged in the magnetic frame, and a magnetic gap is provided between the magnetic frame and each of the main magnet and the pole plate.

9. The speaker as described in claim 8, wherein the vibration unit includes a voice coil and a voice diaphragm, the voice coil being inserted in the magnetic gap, the voice diaphragm being connected to an end of the voice coil facing away from the pole plate.

10. The speaker as described in claim 1, wherein the magnetic circuit unit further includes a main magnet and a pole plate that are sequentially arranged in the magnetic frame, and a magnetic gap is provided between the magnetic frame and each of the main magnet and the pole plate.

11. The speaker as described in claim 1, wherein the sidewall comprises a top surface close to the vibration unit, a distance from the top surface to the bottom wall along the vibration direction of the vibration unit is greater than that from the lower surface of the bracket to the bottom wall.

* * * * *